United States Patent [19]

Astolfi

[11] Patent Number: 4,953,312

[45] Date of Patent: Sep. 4, 1990

[54] PANEL TO BE APPLIED TO BACK OF A PICTURE FRAME FOR RETAINING THE PICTURE AND ITS PROTECTIVE PANEL

[75] Inventor: Pietro Astolfi, Bologna, Italy

[73] Assignee: Pico-Glass, S.P.A., Cadriano, Italy

[21] Appl. No.: 327,292

[22] Filed: Mar. 22, 1989

[30] Foreign Application Priority Data

Oct. 4, 1988 [IT] Italy ..... 22176 A/88

[51] Int. Cl.[5] ..... A47G 1/06

[52] U.S. Cl. ..... 40/156; 40/152.1

[58] Field of Search ..... 40/152, 152.1, 156, 40/642, 643

[56] References Cited

U.S. PATENT DOCUMENTS

| | | | |
|---|---|---|---|
| 631,657 | 8/1899 | Oldenbusch | 40/152 |
| 2,901,850 | 9/1959 | Knox | 40/152 |
| 3,284,940 | 11/1966 | Putman | 40/152.1 |
| 4,063,378 | 12/1977 | Burke | 40/156 |
| 4,211,022 | 8/1980 | Angelakos | 40/156 X |
| 4,736,539 | 4/1988 | Dickinson | 40/152.1 X |

*Primary Examiner*—James R. Brittain

*Attorney, Agent, or Firm*—Darby & Darby

[57] ABSTRACT

A panel to be applied is disclosed which is back of a picture frame for retaining the picture and its protective panel. This is achieved by making at least the width and/or length, greater than the recess of the frame in which rests the picture and the protective retaining panel. Along the periphery of the recess, the frame has a groove into which is inserted the edge of the panel while a substantially central portion engages the protective panel to retain the panel and the picture against removal through the recess of the frame.

6 Claims, 1 Drawing Sheet

PANEL TO BE APPLIED TO BACK OF A PICTURE FRAME FOR RETAINING THE PICTURE AND ITS PROTECTIVE PANEL

FIELD OF THE INVENTION

The present invention relates to a panel for a picture frame, the application of which to the rear of the frame retains the picture and its protective front panel in the frame.

BACKGROUND OF THE INVENTION

Panels applied to the rear of a frame to retain the picture and protective panel are already known, as well as retaining them to the frame by means of metal elements in various shapes and forms. The traditional panels render the construction of a frame somewhat complex, as they must be shaped so that the above-mentioned retaining elements can be applied to them.

A further problem of these panels derives from the fact that the replacement of the picture may only be carried out by removing and then re-applying the metal elements in question, which is not always easy to do.

Another notable problem derives from the fact that in the case of excessive wear and tear or breakage of only one of the metal retaining elements, finding an identical element is often difficult, if not impossible, making the frame virtually useless.

A further problem which must not be overlooked consists in the fact that, in general, the retaining elements of the panel have parts which are to be attached to the frame and parts which are fixed to panel behind the picture, by which the metal element is hooked and which also protect the picture from pressure, traction or other stresses generated by the retaining hook. Besides rendering the frame more costly, because there is a supplementary component, i.e. the protective panel, this makes larger size frames much heavier.

A panel in accordance with the present invention is applied to the rear of the frame for retaining the picture and its protective panel, eliminating all the problems mentioned above.

One of the principle objects of the present invention is therefore to provide a panel of the type mentioned above which completely eliminates every type of metal retaining element, with the consequent advantages.

Another object of the invention is to provide a panel the removal and re-application of which after having substituted the picture is extremely easy and rapid.

BRIEF DESCRIPTION OF THE DRAWING

The characteristics as well as the advantages of the present invention will become more evident from the following detailed description of a presently preferred embodiment, which is to be considered merely illustrative. Referring to the attached drawing.

DETAILED DESCRIPTION OF PREFERRED EMBODIMENT

Figure 1:
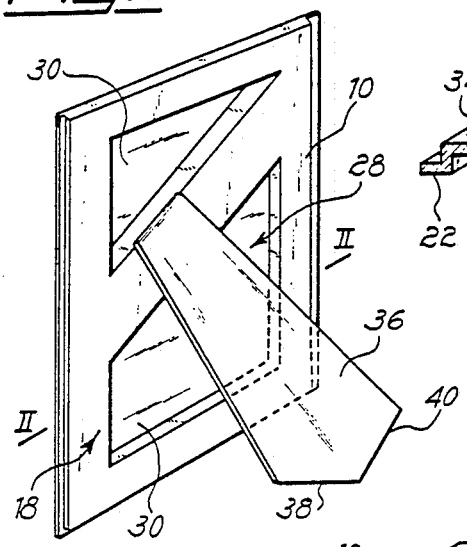
FIG. 1 is a perspective view of the rear of a frame with panel according to the invention.
Figure 3:
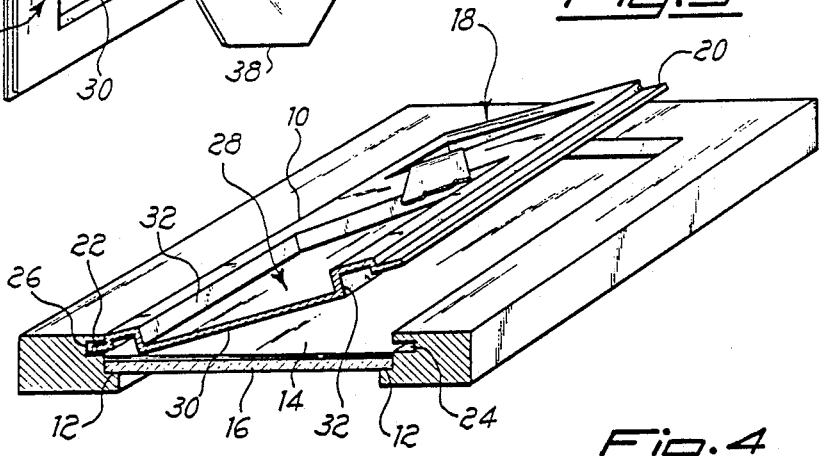
FIG. 3 is a perspective view, partially in section, showing the first phase of the application of the panel to the frame.
Figure 4:
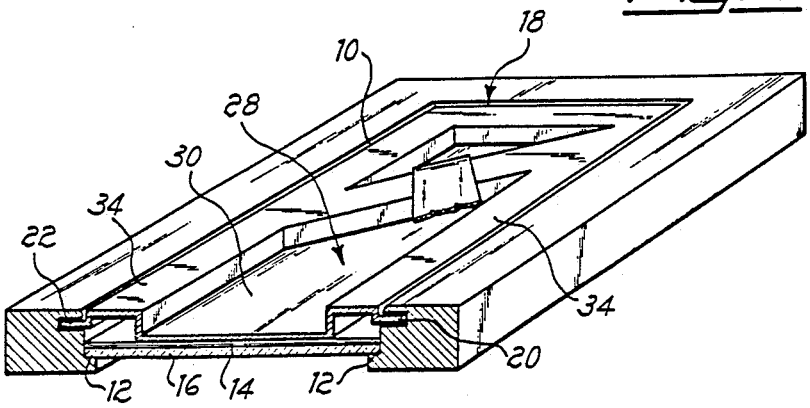
FIG. 4 is a view similar to FIG. 3 showing the panel applied to the frame.

With particular reference to FIGS. 1, 3, and 4, the frame is made up of a substantially rectangular framework 10 the sides of which have on their inner edge a rear recess 12, which extends all around the frame and on which rests the picture 14 and a protective panel 16, such as a pane of glass.

Figure 2:
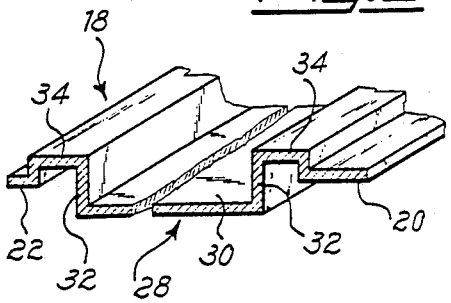
FIG. 2 is a sectional view of the panel according to the invention taken along line II—II of FIG. 1.

Referring now to FIG. 2 there follows a description of the rear panel embodying the present invention, for retaining the picture 14 and its protective panel 16 in frame 10.

The rear panel, represented as a whole by the reference character 18, is preferably made from a sheet of molded plastic material or similar material which has been appropriately shaped and which is, according to a further characteristic, slightly resilient. It is to be noted that the panel 18 ca be slightly deformed into a curved form with respect to a substantially median axis and, once the action provoking the curved deformation has stopped, it returns to its original shape.

According to another fundamental characteristic of the panel according to the invention, one of its two dimensions, in the case of this example the width, is greater than the corresponding width of the recess of the frame 10 on which rests the picture 14 and protective panel 16.

The extra width of panel 18 in this example is made up by two lateral borders 20, 22 of panel 18. As can be seen from FIG. 2 in particular the lateral border 20 is wider than lateral border 22 thus giving major stability to the retaining effect of the panel.

As can be particularly noted from FIGS. 3 and 4, the sides of the frame 10, have on their inside edge above the recess 12, longitudinal grooves 24, 26 to receive the lateral borders 20 and 22 respectively of panel 18, Which in this way is retained by the frame 10.

The application of panel 18 to the frame 10 is easy. For example, border 22 is first inserted in groove 26, then panel 18 is bent slightly, thanks to its elasticity, so as to be able to insert lateral border 20 in groove 24. The panel 18 is then released, so that it resumes its original shape. As represented in FIG. 4 panel 18 is then retained in frame 10.

Furthermore, panel 18 has a recess 28 With a flat bottom 30 for almost all of its surface. The bottom wall 30 of the recess 28, as can be seen from FIG. 4, engages the picture 14 and, therefore, holds the latter and its protective panel 16 in the housing 12 of the frame 10.

Side walls 32 bounding the recess 28 are of a height so that sides 34 of panel 18, which are at a 90° angle to them, are flush with the rear surface of the sides of the frame 10 and thus avoid any discontinuity in the conformation of the rear of the frame.

Finally, the panel 18 has a support arm 36 which permits the frame to be balanced on a shelf. In particular, the end of the arm 36 has two inclined portions 38 and 40 and the frame 10 may be supported by resting one of these two portions on a supporting surface.

It is clear that variations and/or modifications could be made to the panel according to the present invention without departing from the scope and spirit of the invention as defined in the accompanying claims.

For example, panel 18 instead of being made up from a sheet, could also be filled in as regards the parts with dimensions corresponding to the recess 30, 32 on which rest the picture 14 and protective panel 16, from which borders 20 and 22 would protrude in an identical manner to that described above.

I claim:

1. A rear panel for removable application to the rear of a picture frame, said picture frame having a picture receiving opening of a height and width for retaining a picture and an overlying protective panel in said frame opening, at least one of the width and height of said rear panel being greater than the corresponding dimension of said picture-receiving opening, said rear panel having a recess for projecting toward the picture when said frame and rear panel are assembled for use, said recess extending in area for a substantial portion of the total surface area of said rear panel, said recess having a substantially flat bottom that touches and retains said picture in the picture receiving opening when said frame and rear panel are assembled for use, said rear panel including two oppositely protruding borders at least along two opposite edges between which said greater dimension is defined, said borders being dimensioned to be received in corresponding longitudinal grooves in the picture-receiving opening of said frame, each said border being received in one of said grooves when said frame and rear panel are assembled for use, said borders being of an unequal width in the direction of said greater dimension, said rear panel being flexible and requiring flexing to enable insertion of said borders into said corresponding grooves, ease of assembly being enhanced by the uneven width of said borders.

2. A rear panel as in claim 1, wherein said rear panel is a molded plastic sheet.

3. A picture frame assembly comprising:

a picture frame having a picture-receiving opening of a height and width for retaining a picture and an overlying protective panel in said frame opening, said frame having longitudinal grooves created in at least two opposite sides of said picture receiving opening;

a rear panel for removable attachment to said picture frame, said rear panel having at least one of the width and height greater than the corresponding dimension of the picture-receiving opening, said rear panel having a recess projecting toward the picture when the rear panel and picture frame are assembled for use, said recess covering a substantial portion of the total surface area of said rear panel, said recess having a substantially flat bottom wall that touches and retains said picture in the picture receiving opening when said picture frame and rear panel are assembled for use with a picture and overlying protective panel, said rear panel having two oppositely protruding borders at least along two opposite edges between which said greater dimension is defined, said borders being dimensioned to be received in said longitudinal grooves of said frame in said picture receiving opening, said borders being of unequal width in the direction of said greater dimension of said rear panel.

4. A picture frame assembly as in claim 3, wherein said picture frame is rigid and without movable parts.

5. A picture frame assembly as in claim 3, wherein said rear panel is made from a sheet of molded plastic material.

6. A picture frame assembly as in claim 3, wherein said rear panel is made of a material with a limited elasticity, said rear panel being subject to temporary flexural deformation permitting introduction of said borders into said grooves.

* * * * *